United States Patent [19]

Takahashi et al.

[11] Patent Number: 4,982,468

[45] Date of Patent: Jan. 8, 1991

[54] METHOD FOR OPERATING WASHING MACHINE

[75] Inventors: Toshihiro Takahashi; Koichi Ito; Hideyuki Tobita, all of Hitachi, Japan

[73] Assignee: Hitachi, Ltd., Tokyo, Japan

[21] Appl. No.: 473,431

[22] Filed: Feb. 1, 1990

[30] Foreign Application Priority Data

Feb. 13, 1989 [JP] Japan ..... 1-033358

[51] Int. Cl.[5] ..... D06F 33/02

[52] U.S. Cl. ..... 8/159; 68/12 R

[58] Field of Search ..... 8/159; 68/12 R

[56] References Cited

U.S. PATENT DOCUMENTS 4,893,484 1/1990 Takahashi et al. ..... 68/12 R

FOREIGN PATENT DOCUMENTS 172698 10/1982 Japan .
185900 11/1982 Japan .
45479 8/1986 Japan ..... 68/12 R
154194 6/1988 Japan ..... 68/12 R
3154195 6/1988 Japan ..... 68/12 R
262189 10/1988 Japan .

*Primary Examiner*—William A. Cuchlinski, Jr.
*Assistant Examiner*—G. Bradley Bennett
*Attorney, Agent, or Firm*—Antonelli, Terry, Stout & Kraus

[57] ABSTRACT

In a method for operating a washing machine, the accumulated value representative of the number of washing works done in the washing machine is updated and stored in a nonvolatile memory each time such washing work is done. The accumulated value is compared with a predetermined value representative of a tolerance limit number of washing work of such washing machine. In case that the accumulated value is beyond the predetermined value, the washing machine is made inoperative. The user may be informed visually and/or acoustically of the inoperative condition of such washing machine.

22 Claims, 6 Drawing Sheets

METHOD FOR OPERATING WASHING MACHINE

FIELD OF THE INVENTION AND RELATED ART STATEMENT

The present invention relates to a method for operating a washing machine, e.g., an electronic controlled washing machine incorporating an electronic controller.

In general, the average lifetime or the renewal cycle of the washing machines is 5 to 10 years. However, the average lifetime varies according to the environment of the place where the washing machine is installed and to the frequency of the operation thereof. The scatter in the average lifetime is considerable. When the washing machine is used in the dormitory or the hospital, and in particular when it is used for business purpose, the operation frequency thereof is high and accordingly the lifetime thereof is decreased drastically. High operation frequency and large number of operations result in remarkable damage of parts constituting the washing machine. Especially, deterioration of the insulation of a condenser or the like employed in a motor of the washing machine brings about fuming and firing.

However, in the conventional washing machines, it is impossible for the user to know the accumulated number of times that the washing machine has been operated so far. Namely, the user operates the washing machine without noticing whether or not the parts of the washing machine have been deteriorated. This gives rise to a fear of fuming and firing caused by that the user continues to operate the washing machine without noticing the deterioration of the parts.

Meanwhile, there have been proposed clothing dryers and the like which are designed to indicate information respondent to the number of times of operation thereof so as to attract the user's attention.

In this case, however, if the user overlooks or disregards such information, he or she continues to operate, resulting in failure to avoid the risk mentioned above after all.

OBJECT AND SUMMARY OF THE INVENTION

Accordingly, an object of the present invention is to provide a method for operating a washing machine which is free from danger of fuming and firing.

To this end, according to the present invention, there is provided an operation method comprising the steps of: reading out the number of times of washing work done stored in a nonvolatile memory; comparing the read-out number of times of washing work done with a predetermined tolerance limit number of times of washing work; making the washing machine inoperative when the read-out number of times of washing work done is beyond the predetermined tolerance limit number; and updating the accumulated number of times of washing work done and storing the update number of times into the nonvolatile memory each time the washing work is done.

According to the present invention, since it is impossible to operate the washing machine beyond its tolerance limit number of times of washing work, the above-described risk can be avoided.

Further, according to another aspect of the present invention, not only is it possible to make the washing machine inoperative so as to avoid fuming and firing, but also it is possible to inform the operator that the washing machine is inoperative since the number of the times of washing work done reaches the tolerance limit number of times of washing work thereof. This makes it possible to perform a smooth replacement and proper inspection of deteriorated parts.

Functions and effects of the present invention will become more clear from the following description of preferred embodiments in detail with reference to the accompanying drawings.

DETAILED DESCRIPTION OF PREFERRED EMBODIMENTS

Figure 1:
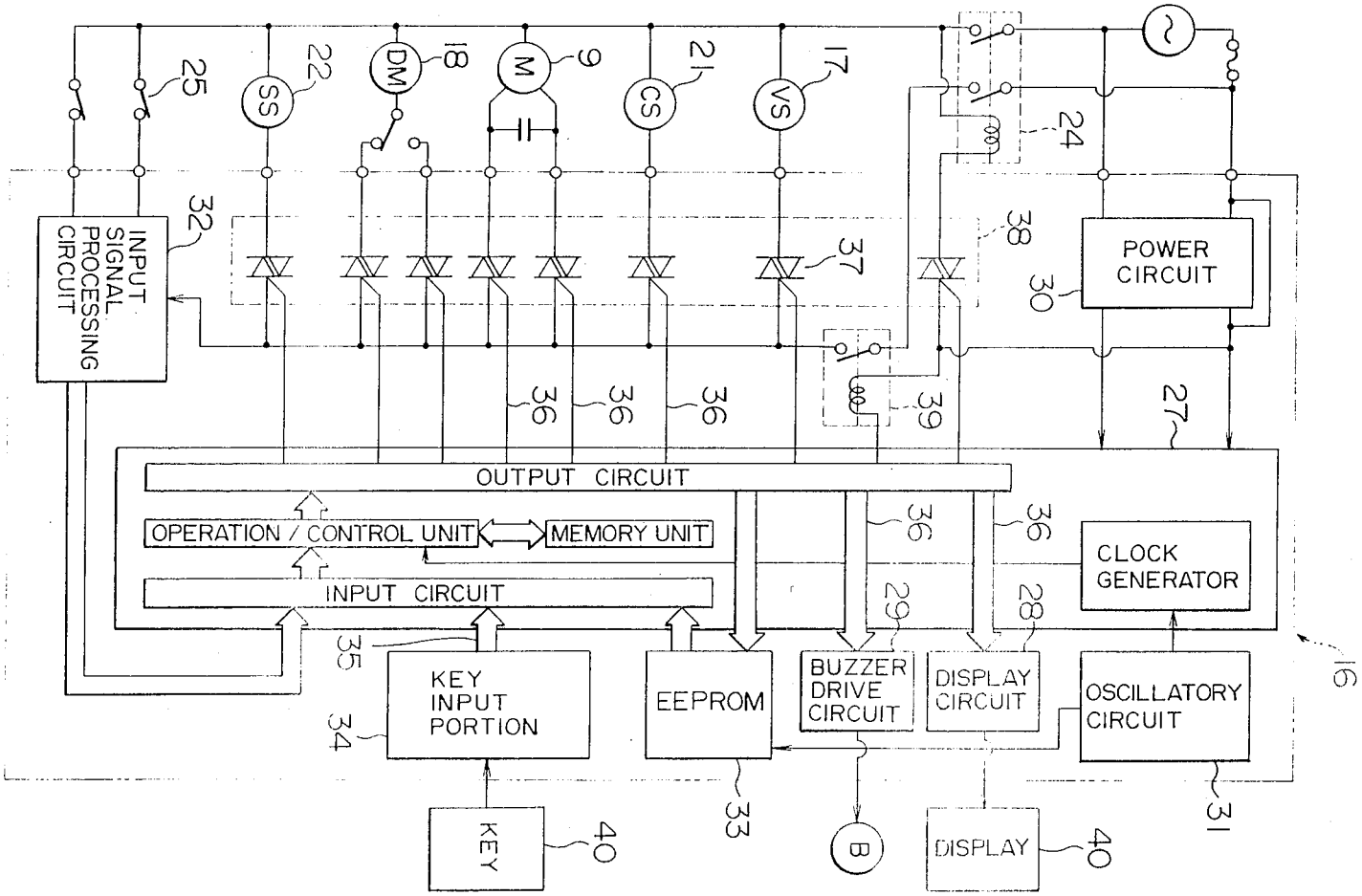
FIG. 1 is a block diagram of an electronic control circuit of a washing machine, which carries out an embodiment of the present invention.
Figure 2:
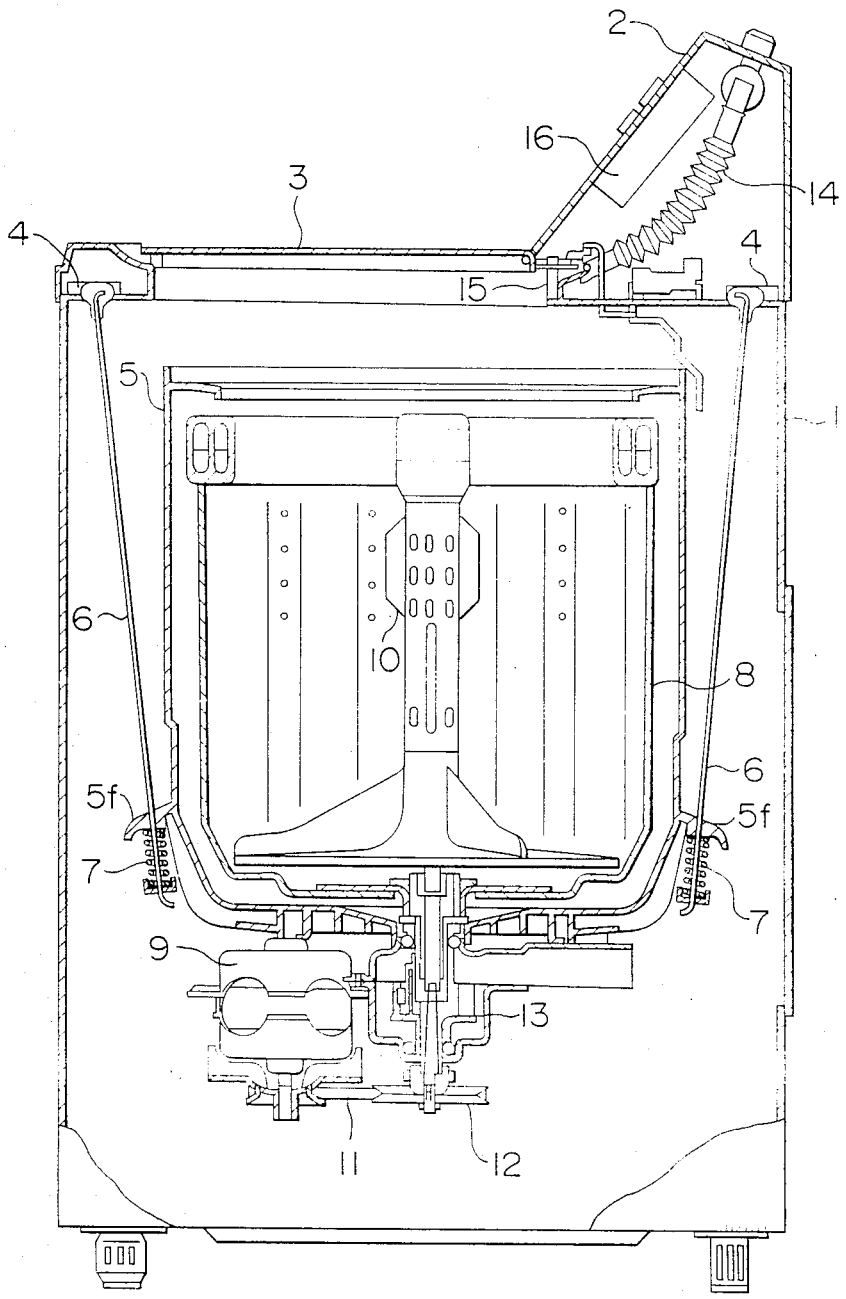
FIG. 2 is a sectional view of a washing machine incorporating the electronic control circuit shown in FIG. 1.

An electronic controlled washing machine to which an embodiment of the present invention is applied, which incorporates an electronic control circuit shown in FIG. 1, has a frame 1, a stop cover 2 covering a top portion of the frame 1, a lid 3 pivotally mounted to the top cover 2, and a water tub 5 disposed in the frame 1, as shown in FIG. 2. The water tub 5 is suspended at flange portions **5*f* thereof by means of rods 6. The rod 6 is secured at one end thereof to and extends from a corner plate 4 fixed at the respective four corners of the top portion of the frame 1. A spring 7 is provided between the flange portion 5*f* and the other end of the rod 6 so as to absorb vibration of the water tub 5 during the dry spinning operation. A basket 8 provided at an outer peripheral wall thereof with numerous pores is disposed inside the water tub 5. A motor 9 is provided under the water tub 5 for the purpose of rotating the basket 8 or an agitator 10 disposed in the basket 8. Rotating force of the motor 9 is transmitted through a belt 11, a pulley 12 and clutch/reduction gears 13 to the basket 8 or the agitator 10. The clutch/reduction gears 13 is brought into and out of the state of engagement by means of a solenoid 21 (FIG. 1) so as to change over from high-speed rotation of the basket 8 (on dry spinning operation) to low-speed rotation of the agitator 10 (on washing operation) and vice versa. The direction of rotation of the agitator 10 is alternated by alternating the direction of rotation of the motor 9 by means of an electronic controller 16 which will be described later. Water is supplied from a port 15 into the water tank 5 through a hose 14. A flow control valve is provided at an intermediate point in the hose 14 to control a flow rate of water to be supplied. Water in the water tub 5 is discharged through a drain port (not shown) and a drain valve (not shown) which are provided in the water tub 5. The frame 1** is further provided with a softener dispenser (not shown).

The electronic controller 16 is mounted to the top cover 2. The electronic controller 16 controls a solenoid 17 for actuating the flow control valve, the solenoid 21 for actuating the clutch/reduction gears 13, the motor 9, a motor 18 for actuating the drain valve, and a solenoid 22 for actuating the softener dispenser (FIG. 1).

As shown in FIG. 1, the electronic controller 16 comprises a CPU (central processing unit) constituted by an LSI (large scale integration), a display circuit 28 serving to drive LEDs (light emitting diodes) of an input/display panel 40 which is arranged on the top cover 2 and is to be described later, a buzzer drive circuit 29 for driving a buzzer B, and a power circuit 30. The power circuit 30 transforms high voltage alternating current (AC 100 V) to low voltage direct current (DC 5.5 V) so as to supply the latter to the respective circuits. The CPU 27 includes a clock generator, a memory unit, an operation/control unit, an input circuit, and an output circuit. These units are connected to each other by means of bus lines.

Further, the electronic controller 16 comprises an oscillatory circuit 31, an input signal processing circuit 32, a key input portion 34, and a driving unit 38 having a plurality of switching elements such as a TRIAC 37. The oscillatory circuit 31 supplies an oscillated signal to the clock generator of the CPU 27. The key input portion 34 receives a keying input from the input/display panel 40 and then transmits input commands to the input circuit of the CPU 27 through a bus line 35. Signals from the input circuit are transmitted to the operation/control unit. The operation/control unit compares and judges the signals from the input circuit with data read out from the memory unit and then transmits output signals to the output circuit. The output circuit transmits output signals to the driving unit 38, the display circuit 28 and the buzzer drive circuit 29, respectively, through bus lines 36. Reference numeral 39 denotes a relay which is driven in response to the output signals from the CPU 27. The CPU 27 activates the relay 39 and the TRIACs 37 so as to supply the high voltage alternating current through from a power switch 24 to the solenoid 17 for the flow control valve, the solenoid 21 for the clutch/reduction gears 13, the motor 9, the motor 18 for the drain valve and the solenoid 22 for the softener dispenser, individually.

In addition, the electronic controller 16 is provided with a rewritable nonvolatile memory, e.g., an electrically erasable programmable read only memory (EEPROM) 33.

Figure 3:
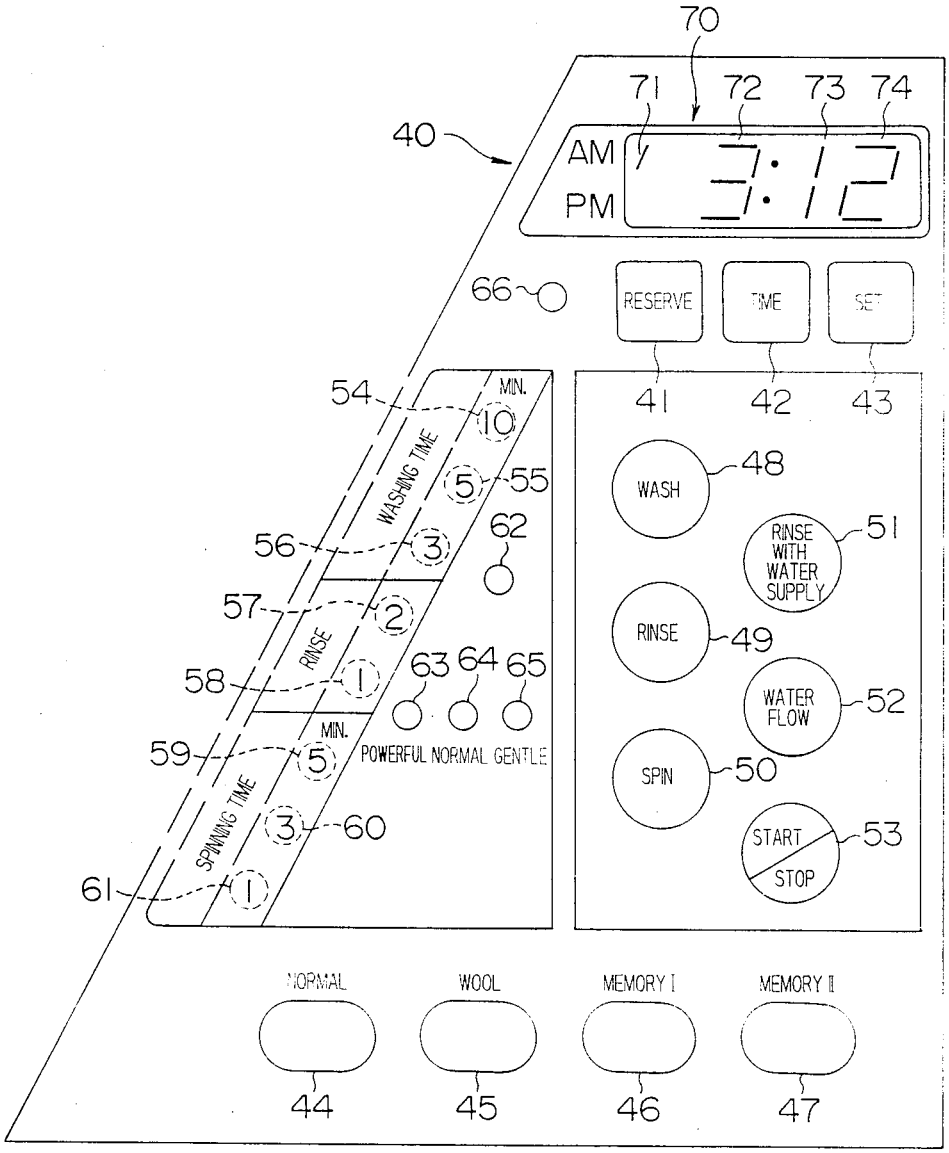
FIG. 3 is a front view of an input/display panel of the washing machine shown in FIG. 2.

On the other hand, as shown in FIG. 3, the input/display panel 40 provided with keys used for deciding the operation states of the washing machine has thirteen input keys 41 to 53, thirteen LEDs 54 to 66, and a single LED unit 70 of 4 digits each composed of 7 segmentations.

The Keys 41 to 43 are used for setting the present time and the end time of operation. The key 41 is a reserve key, the key 42 is a time key, and the key 43 is a setting key. As the key 41 is depressed, the LED 66 is lighted to indicate that a programmed reservation operation is selected. A diode 71 of 7 segmentations indicates a.m. or p.m. Diodes 72 to 74 of 7 segmentations represent the hour, the ten-digit in the minute representation and the one-digit in the minute representation, respectively. The keys 41 to 43 are selectively depressed to set the present time and the end time of operation.

The keys 44 to 47 are used for selecting one out of four different full automatic controlled washing works each combining a washing, a rinsing, and/or a dry spinning operation together in the respective predetermined manner. The key 44 is depressed in case of selecting a normal washing work. The key 45 is depressed in case of selecting a gentle washing work for woolen clothing and the like. The keys 46 and 47 are depressed when the operator intends to perform the washing work in the manners respectively predetermined in advance according to his or her preference.

In case of performing the washing work in the manner freely selected by the operator, the keys 48 to 52 are depressed when necessary. The key 48 is depressed to set the time period during washing operation. Depression of the key 48 causes the LEDs 54 to 56 for representation of the time period during washing operation to light in order. Lighting of the LEDs 54 to 56 displays the FIGS. 3, 5 and 10 representative of the respective time periods during washing operation, i.e., three minutes, five minutes and ten minutes. The key 49 is depressed in case of setting the number of repetitions of rinsing operation. Depression of the key 49 causes the LEDs 57 and 58 to light alternately. Lighting of the LEDs 57 and 58 displays the FIGS. 1 and 2 representative of the respective numbers of repetitions of rinsing operation, i.e., one time and two times. Depression of the key 50 lights the LEDs 59 to 61 for representation of the time period during dry spinning operation in order. Lighting of the LEDs 59 to 61 displays the FIGS. 1, 3 and 5 representative of the respective time periods during dry spinning operation, i.e., one minute, three minutes and five minutes. The key 51 is depressed in case of performing a rinsing operation with water supply. As the key 51 is depressed, the LED 62 is lighted to indicate that the rinsing operation with water supply is selected. The key 52 is depressed in case of setting the intensity of water flow, i.e., the duty cycle of power supply to the motor 9. As the key 52 is depressed, the LEDs 63 to 65 are lighted in order, which represent the respective intensities of water flow, i.e., powerful, normal and gentle.

Next, operation of this embodiment will be described with reference to FIGS. 1, 3 and 4A.

First of all, as the power switch 24 is turned on, the CPU 27 drives the relay 39. This enables power supply to the loads of the washing machine, that is, to the solenoid 17 for the flow control valve, the solenoid 21 for the clutch/reduction gears 13, the motor 9, the motor 18 for the drain valve and the solenoid 22 for the softener dispenser. Concurrently, the CPU 27 reads out the data on the accumulated number of times of washing work done from the EEPROM 33 (at step 401 of FIG. 4A). Subsequently, the CPU 27 makes a comparison for judging whether or not the read-out accumulated number of times of washing work done has reached a tolerance limit number (e.g., 5000 times) predetermined in advance (at step 402 of FIG. 4A). When it is judged that the accumulated number of times of washing work done does not reach the tolerance limit number, a keying input from the input/display panel 40 is accepted (at step 403 of FIG. 4A). Then, the operator depresses the keys on the input/display panel 40 so as to choose between 9 desired one of four different full automatic controlled washing works and a washing work combining desired operations selected by the operator. As the operator depresses the start/stop key 53, keyed input commands from the input/display panel 40 are transmitted through the key input portion 34 and the input circuit to the operation/control unit of the CPU 27 so as to make the washing machine operate (at step 404 of FIG. 4A). Concurrently with this, the operation/control unit updates the accumulated number of times of washing work done stored in the EEPROM 33 (at step 405 of FIG. 4A) and, further, to erase the data on the accumulated number of times of washing work done as well as to write the updated data in the EEPROM 33 as new date (at step 406 of FIG. 4A). In case that any one of the keys 44 to 47 is depressed, the operation/control unit reads out from the memory unit the predetermined routine stored therein and then supplies power to the necessary loads for operation in accordance with the read-out routine. On the contrary, in case that one or more of the keys 48 to 52 is depressed, the operation/control unit supplies power to the necessary loads for operation in accordance with the keyed input commands.

More specifically, the operation/control unit accepts a signal from a pressure switch 25 for detecting a level of water in the water tub 5 through the input signal processing circuit 32 and judges whether or not water is impounded in the water tub 5 sufficiently. If it is judged that water is not impounded in the water tub 5 sufficiently, the operation/control unit outputs a water supply commencement command to the TRIAC 37 of the driving unit 38 associated with the solenoid 17 through the bus line 36. In consequence, the solenoid 17 for the flow control valve is operated to supply water into the water tub 5. As water is impounded in the water tub 5 sufficiently, the operation/control unit receives a signal from the pressure switch 25 to interrupt power supply to the solenoid 17 for the flow control valve.

Then, in order to perform the washing operation, the operation/control unit operates the driving unit 38 so as to supply the power to the motor 9 and the solenoid 24 for the clutch/reduction gears 13 to actuate them. At the same time, the detergent is thrown into the water tub 5. The motor 9 drives the agitator 10 to repeat an operation cycle including a clockwise rotation, a pause, a counterclockwise rotation and a pause in the mentioned order. This contributes to application of the mechanical power to the washing. Thereafter, the operation/control unit actuates the motor 18 to operate the drain valve, thereby draining water from the water tub 5. Water is supplied again into the water tub 5 and then the motor 9 drives the agitator 10 to repeat the same operation cycle as described above. In this way, the rinsing operation is performed. Then, the operation/control unit operates the driving unit 38, to supply the power to the solenoid 22 for the softener dispenser if necessary demands, thereby allowing the softener to be supplied into the water tub 5. Subsequently, the operation/control unit actuates the motor 18 again to operate the drain valve, thereby draining water from the water tub 5. Furthermore, it operates the driving circuit 38 to supply the power to the motor 9 so as to actuate the same, thus causing the basket 8 to rotate at the high speed. In this way, the dry spinning operation is performed. As a result, a series of operations of the washing work are completed.

Figure 4A:
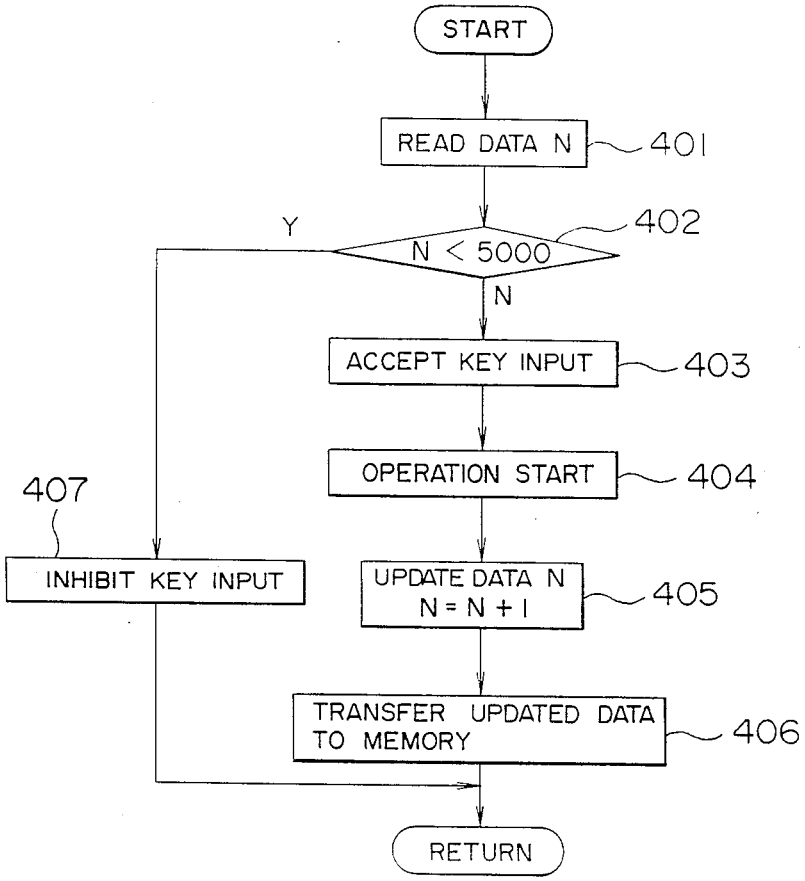
FIG. 4A is a flow chart showing the procedure for operating the washing machine shown in FIG. 2.

On the other hand, when it is judged that the accumulated number of times of washing work done has reached the tolerance limit number, the keying input from the input/display panel 40 is not accepted (at step 407 of FIG. 4A). Therefore, the washing machine is by no means operated. Namely, the LEDs do not light even if any key of the input/display panel 40 is depressed, and therefore, the washing machine is kept inoperative. From this matter, the operator comes to know that the number of times of washing work done by the washing machine has reached the tolerance limit. Further, in the present embodiment, in order to inform the operator more evidently that the number of times of washing work done by the washing machine has reached the tolerance limit and accordingly it is necessary to repair and check the washing machine, various measures are taken such as to flash the LEDs, to buzzer and to make the LED unit 70 display a special indication.

Figure 4B:
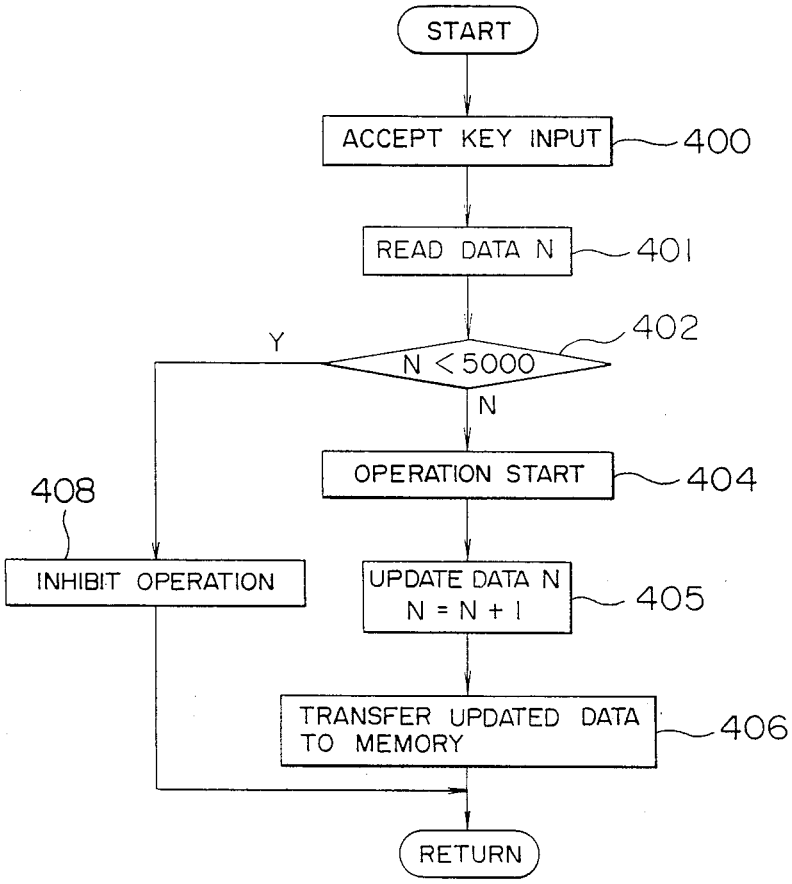
FIGS. 4B and 4C are flow charts showing respectively the operation procedures of other embodiments.

In the case of another embodiment shown in FIG. 4B, the keying input from the input/display panel 40 is accepted first of all (at step 400 of FIG. 4B). Then, as the operator depresses the start/stop key 53, the CPU 27 reads out the data on the accumulated number of times of washing work done from the EEPROM 33 (at step 401 of FIG. 4B). Subsequently, the CPU 27 makes a comparison for judging whether or not the readout accumulated number of times of washing work done has reached a tolerance limit number e.g., 5000 times) predetermined in advance (at step 402 of FIG. 4B). When it is judged that the accumulated number of times of washing work done does not reach the tolerance limit number, the same washing work as in the aforesaid embodiment is carried out. The operation/control unit updates the accumulated number of times of washing work done stored in the EEPROM 33 (at step 405 of FIG. 4B) and, further, erases the data on the stored accumulated number of times of washing work done as well as writes the data on the updated number of times of washing work done in the EEPROM 33 as new data (at step 406 of FIG. 4B). On the other hand, when it is judged that the accumulated number of times of washing work done has reached the tolerance limit number, the operation/control unit puts out the LEDs which are lighting for representation of the selected operations. In addition, the operation/control unit inhibits the power supply to every load of the washing machine so as to make it inoperative. Thereafter, in order to inform the operator more evidently that the number of times of washing work done by the washing machine has reached the tolerance limit number and accordingly it is necessary to repair and check the washing machine, various measures are taken such as to flash the LEDs, to operate the buzzer B and to make the LED unit 70 display a special indication.

Figure 4C:
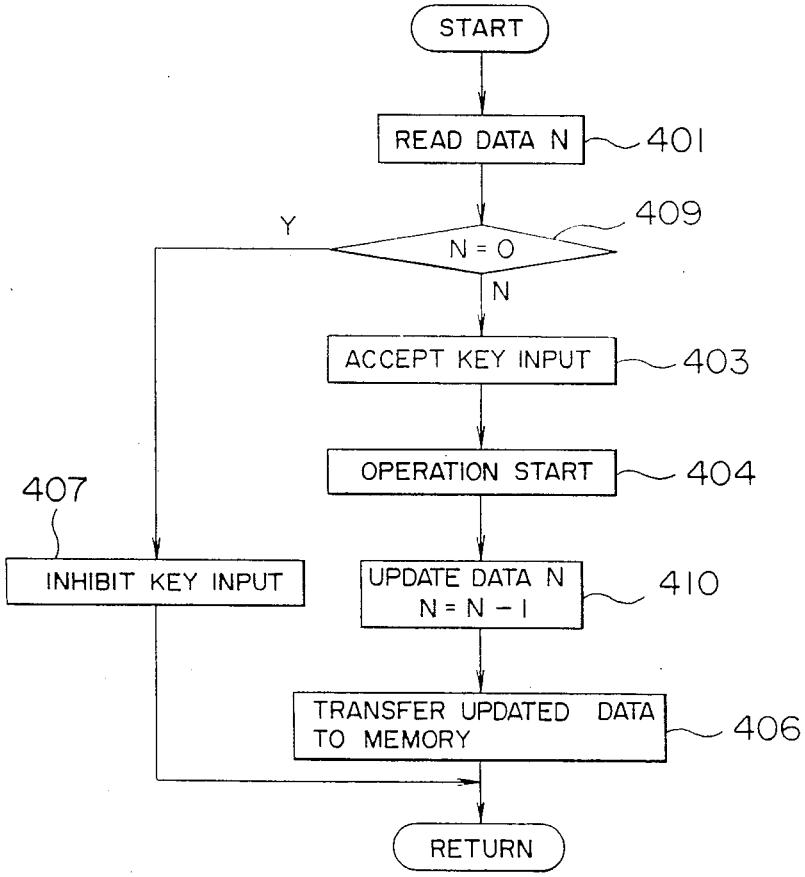

In the case of still another embodiment shown in FIG. 4C, in order to judge whether or not the accumulated number of times of washing work done has reached a tolerance limit number predetermined in advance, updating of the data is executed by adding a negative increment "−1" to the initial value that is the tolerance limit number (e.g., 5000 times ) (at step 410 of FIG. 4C), in place of updating the data by adding a positive increment "+1" to the data on the accumulated number of times of washing work done as in the aforesaid embodiments. In the present embodiment, therefore, the fact that the updated data becomes 0 (zero) (at step 410 of FIG. 4C) means that the accumulated number of times of washing work done has reached the tolerance limit number predetermined in advance. Other steps are the same as those shown in FIG. 4A.

According to the present invention, since a nonvolatile memory (e.g., a rewritable nonvolatile memory) is used as the memory in which the updated number of times of washing work done is written, even if the power supply is interrupted after the operation of the washing machine, the written-in data is by no means erased, thus making it possible to update the number of times of washing work done accurately without fail. Further, since it is designed that the washing machine is made to be inoperative by force when the number of times of washing work done has reached the tolerance limit number predetermined in advance, there is no possibility that the user continues to operate the washing machine without noticing the damage of the parts and, accordingly, there is no fear of fuming and firing.

What is claimed is:

1. A method for operating a washing machine which can selectively conduct a washing work in which a single operation or two or more operations selected from among a washing, a rinsing, and a dry spinning operation is carried out solely or in combination by means of supplying outputs to a load of said washing machine in accordance with commands inputted thereinto, said method comprising the following steps of:

reading out an accumulated value stored in a nonvolatile memory, representative of the number of washing works done in said washing machine;

comparing said read-out accumulated value with a value predetermined in advance, which is representative of a tolerance limit number of washing work of said washing machine;

making said washing machine inoperative when said read-out accumulated value is beyond said predetermined value; and updating said accumulated value and storing the updated value into said nonvolatile memory as a new accumulated value each time such washing work is carried out in said washing machine.

2. A method according to claim 1, wherein said inoperating step is carried out by inhibiting said commands from being inputted into said washing machine.

3. A method according to claim 2, wherein said method further comprises a step of informing an operator visually and/or acoustically that said washing machine is inoperative in case that said read-out accumulated value is beyond said predetermined value.

4. A method according to claim 2, wherein said inoperating step is carried out by inhibiting said commands from being key-inputted into said washing machine.

5. A method according to claim 1, wherein said inoperating step is carried out by inhibiting said outputs from being supplied to said load of said washing machine.

6. A method according to claim 5, wherein said method further comprises a step of informing an operator visually and/or acoustically that said washing machine is inoperative in case that said read-out accumulated value is beyond said predetermined value.

7. A method according to claim 1, wherein said method further comprises a step of informing an operator visually and/or acoustically that said washing machine is inoperative in case that said read-out accumulated value is beyond said predetermined value.

8. A method according to claim 7, wherein said informing step is carried out by flashing or lighting a luminous element.

9. A method according to claim 7, wherein said informing step is carried out by operating an electric buzzer.

10. A method according to claim 1, wherein said nonvolatile memory is a rewritable one.

11. A method according to claim 10, wherein said rewritable nonvolatile memory is an electrically erasable programmable nonvolatile memory.

12. A method for operating an electronically controlled washing machine which can selectively perform, by means of supplying outputs to a load of said washing machine in accordance with commands inputted thereinto, a full automatic controlled washing work in which a washing, a rinsing, and a dry spinning operation are carried out in the order set in advance, and a selected washing work in which at least one operation selected from among a washing, a rinsing, and a dry spinning operation is carried out solely or in combination in the order set by an operator, said method comprising the following steps of:

reading out an accumulated value stored in a nonvolatile memory, representative of the number of washing works done in said washing machine;

comparing said read-out accumulated value with a value predetermined in advance, which is representative of a tolerance limit number of washing work of said washing machine;

inoperating said washing machine when said read-out accumulated value is beyond said predetermined value; and updating said accumulated value and storing the updated value into said nonvolatile memory as a new accumulated value each time such washing work is carried out in said washing machine.

13. A method according to claim 12, wherein said inoperating step is carried out by inhibiting said commands from being inputted into said washing machine.

14. A method according to claim 13, wherein said method further comprises a step of informing an operator visually and/or acoustically that said washing machine is inoperative in case that said read-out accumulated value is beyond said predetermined value.

15. A method according to claim 12, wherein said inoperating step is carried out by inhibiting said outputs from being supplied to said load of said washing machine.

16. A method according to claim 15, wherein said method further comprises a step of informing an operator visually and/or acoustically that said washing machine is inoperative in case that said read-out accumulated value is beyond said predetermined value.

17. A method according to claim 12, wherein said method further comprises a step of informing an operator visually and/or acoustically that said washing machine is inoperative in case that said read-out accumulated value is beyond said predetermined value.

18. A method according to claim 17, wherein said informing step is carried out by flashing or lighting a luminous element.

19. A method according to claim 17, wherein said informing step is carried out by operating an electric buzzer.

20. A method according to claim 12, wherein said inoperating step is carried out by inhibiting said commands from being key-inputted into said washing machine.

21. A method according to claim 12, wherein said nonvolatile memory is a rewritable one.

22. A method according to claim 21, wherein said rewritable nonvolatile memory is an electrically erasable programmable nonvolatile memory.

* * * * *